US005551810A

United States Patent [19]

Franceski et al.

[11] Patent Number: 5,551,810

[45] Date of Patent: Sep. 3, 1996

[54] RETAINING WALL WITH AN OUTER FACE AND METHOD OF FORMING THE SAME

[75] Inventors: John A. Franceski, Aurora, Colo.; Hubert J. Deaton, III, Great Falls, Va.; Claus J. Ludwig, Walnut Creek, Calif.

[73] Assignee: Schnabel Foundation Company, Sterling, Va.

[21] Appl. No.: 257,776

[22] Filed: Jun. 8, 1994

[51] Int. Cl.[6] ..... F02D 29/02

[52] U.S. Cl. ..... 405/286; 405/284; 405/262

[58] Field of Search ..... 405/262, 284, 405/285, 286, 287, 287.1

[56] References Cited

U.S. PATENT DOCUMENTS

| | | | |
|---|---|---|---|
| Re. 28,977 | 9/1976 | Mason | 61/39 |
| 1,270,659 | 6/1918 | Ravier . | |

(List continued on next page.)

FOREIGN PATENT DOCUMENTS

| | | | |
|---|---|---|---|
| 2233857 | 2/1975 | France . | |
| 2917994 | 10/1980 | Germany . | |
| 3810970 | 10/1989 | Germany | 405/284 |
| 199532 | 8/1991 | Japan | 405/286 |
| 4102630 | 4/1992 | Japan | 405/284 |
| 2102866 | 2/1983 | United Kingdom . | |

OTHER PUBLICATIONS

Plans and Calculations (sheets 1–7), SR–91 Brigham City to Mantua Tieback Retaining Wall, Schnabel Foundation Company, dated Feb. 19, 1993.

Plans and Calculations (sheets 1–7), SR–91 Brigham City to Mantua Tieback Retaining Wall, Schnabel Foundation Company, dated May 10, 1993.

Preliminary Sketches (2 sheets), Box Elder Canyon Tieback Wall, SR–91, Utah, dated Nov. 23, 1992.

Plans and Calculations (sheet 4), SR–91 Brigham City to Mantua Tieback Retaining Wall, Schnabel Foundation Company, dated Feb. 19, 1993.

Meeting Minutes (2 pages), "Retaining Walls on SR–91 Brigham City to Mantua", Centennial Engineering Co., Utah Dept. of Transportation and Federal Highway Administration attending, Jun. 8, 1993.

C. Louis, "New Support Method for Cut Slopes", Revue Travaux, Mar. 1981, pp. 67–75.

C. Louis, "Latest Developments In Soil Nailing", 1985.

"Soil and Rock Anchors", VSL Corporation Brochure, p. 9, Apr. 1978.

VSL Newsletter, p. 11, Nov. 1982.

*Primary Examiner*—David J. Bagnell
*Assistant Examiner*—Frederick L. Lagman
*Attorney, Agent, or Firm*—Banner & Allegretti, Ltd.

[57] ABSTRACT

A retaining wall system is comprised of a retaining wall with an outer face. A cut is excavated in successive sections to form exposed cut faces. The exposed cut face of each successively excavated section may be temporarily supported with pneumatically applied concrete. A concrete wale is then formed horizontally along a portion of the exposed cut face of each successively excavated section. Next, tiebacks are installed through the concrete wale. The tiebacks are tested, tensioned and secured against the concrete wale. After the excavation has been completed and the retaining wall formed, an outer face is provided which extends to the full height of the retaining wall. A concrete footing is first provided at the base of the retaining wall. Next, a first tier of facing elements is erected above the concrete footing. These facing elements are then secured to a first adjacent concrete wale at a first connection point. Backfill material is placed between the first tier of facing elements and the retaining wall. Finally, concrete is placed between the first tier of facing elements and the retaining wall to thereby encase the first connection point. The outer face thus effectively ties together the concrete wales and tiebacks of the retaining wall to further support the excavated slope. Additional tiers of facing elements are added as necessary. Additional vertical support may be provided by elongated reinforcement posts disposed between the footing and adjacent concrete wales, or by mini-piles.

61 Claims, 12 Drawing Sheets

U.S. PATENT DOCUMENTS

| | | | |
|---|---|---|---|
| 1,739,108 | 12/1929 | Weber . | |
| 1,747,038 | 2/1930 | Weber . | |
| 1,761,614 | 3/1930 | Collier . | |
| 1,762,343 | 6/1930 | Munster . | |
| 1,909,980 | 5/1933 | Newman . | |
| 1,933,483 | 10/1933 | Pennoyer | 61/39 |
| 2,000,492 | 5/1935 | McKeen | 61/39 |
| 2,045,112 | 6/1936 | Upson | 61/39 |
| 2,110,253 | 3/1938 | Nedden | 61/39 |
| 3,198,614 | 8/1965 | Powell | 61/49 |
| 3,226,933 | 1/1966 | White | 61/39 |
| 3,243,963 | 4/1966 | Schnabel, Jr. | 61/39 |
| 3,250,075 | 5/1966 | Webb et al. | 61/39 |
| 3,412,562 | 11/1968 | Doughty | 61/39 |
| 3,438,207 | 4/1969 | Turzillo | 61/35 |
| 3,464,211 | 9/1969 | Andresen | 61/35 |
| 3,490,242 | 1/1970 | Schnabel, Jr. | 61/39 |
| 3,530,676 | 9/1970 | York | 61/39 |
| 3,541,798 | 11/1970 | Schnabel, Jr. | 61/39 |
| 3,555,830 | 1/1971 | York | 61/39 |
| 3,638,435 | 2/1972 | Mason | 61/39 |
| 3,802,204 | 4/1974 | Mason | 61/39 |
| 3,807,182 | 4/1974 | Schnabel, Jr. | 61/35 |
| 3,922,864 | 12/1975 | Hilfiker | 61/35 |
| 3,999,391 | 12/1976 | Meredith | 61/39 |
| 3,999,392 | 12/1976 | Fukushima et al. | 61/39 |
| 3,999,398 | 12/1976 | Kurose | 61/49 |
| 4,055,927 | 11/1977 | Tamaro | 52/577 |
| 4,106,225 | 8/1978 | Schnabel, Jr. | 37/184 |
| 4,117,686 | 10/1978 | Hilfiker | 405/284 |
| 4,124,983 | 11/1978 | Weatherby | 405/260 |
| 4,242,013 | 12/1980 | Watts | 405/272 |
| 4,318,637 | 3/1982 | Oger et al. | 405/153 |
| 4,343,572 | 8/1982 | Hilfiker | 405/284 |
| 4,369,004 | 1/1983 | Weatherby | 405/262 |
| 4,391,557 | 7/1983 | Hilfiker et al. | 405/287 |
| 4,407,611 | 10/1983 | Murray et al. | 405/284 |
| 4,426,176 | 1/1984 | Terada | 405/285 |
| 4,448,571 | 5/1984 | Eckels | 405/284 |
| 4,449,857 | 5/1984 | Davis | 405/286 |
| 4,470,728 | 9/1984 | Broadbent | 405/285 |
| 4,480,945 | 11/1984 | Schnabel, Jr. | 405/262 |
| 4,505,621 | 3/1985 | Hilfiker et al. | 405/284 |
| 4,514,113 | 4/1985 | Neumann | 405/286 |
| 4,561,804 | 12/1985 | Weatherby | 405/262 |
| 4,564,316 | 1/1986 | Hunziker | 405/262 |
| 4,718,791 | 1/1988 | Weatherby | 405/262 |
| 4,718,792 | 1/1988 | Louis | 405/262 |
| 4,732,510 | 3/1988 | Louis | 405/269 |
| 4,911,582 | 3/1990 | Peirce, Jr. et al. | 405/262 |
| 4,911,583 | 3/1990 | Carey | 405/262 |
| 4,913,594 | 4/1990 | Jigourney | 405/286 X |
| 5,002,436 | 3/1991 | Sigourney | 405/262 |
| 5,356,242 | 10/1994 | Elmore et al. | 405/787 X |
| 5,395,185 | 3/1995 | Schnabel, Jr. | 405/287 |

20
32c
40c
34c
39
35b
22
41
60
30
95
96
25b
37
95
41
34b
32b
40b
23
39
35a
41
36a
90
22
33a
60
32a
90
25a
41
34a
40a

RETAINING WALL WITH AN OUTER FACE AND METHOD OF FORMING THE SAME

BACKGROUND OF THE INVENTION

1. Field of the Invention

The present invention is directed to a retaining wall system. More particularly, the present invention is directed to a retaining wall system comprised of a retaining wall and an outer face. A method of forming such a retaining wall system is also provided. The disclosed retaining wall system and method are particularly adapted for use with excavated slopes or embankments formed in ground formations containing cobbles, boulders, rock, weathered rock, or cemented soil. Existing retaining wall structures and methods are either incompatible with ground formations containing such hard materials or present costly, unattractive or undesirable alternatives.

2. Description of the Prior Art

Tied Back Walls

One method of supporting the sides of excavations is to use a tied back wall. A tied back wall utilizes a plurality of tiebacks. A tieback comprises a grouted anchor installed in the ground mass to secure a tendon which applies a force to the earth retaining wall. The tiebacks and retaining wall support the ground mass behind the wall.

In a tied back wall, the force necessary to support the side of an excavation is applied to the tieback by testing and prestressing it against piles installed vertically in the ground mass. These vertical piles are commonly known as soldier beams. This method consists of the following steps:

- installing a plurality of soldier beams into the soil mass in the area of the retaining wall to be formed;
- excavating the ground in front of the wall from the top down in successive sections;
- installing wood or precast concrete lagging between the soldier beams, or alternatively placing pneumaticaily applied concrete or cast-in-place concrete to help support the exposed face of the excavated section of the ground;
- installing tiebacks into the soil mass;
- testing and prestressing the tiebacks against the soldier beams;
- repeating the above steps as needed; and
- pouring a final outer layer of concrete over the pilings, lagging and tiebacks to form a permanent tied back wall.

U.S. Pat. No. 4,561,804 shows one type of tied back wall. The exposed face of the cut is supported in part by vertical sheet piles and either timber lagging or a layer of pneumaticaily applied concrete. The soil is then removed in descending stages until further support becomes necessary. At this point, tiebacks are installed through the sheet piles and into the soil mass. The tiebacks are then secured, tested and prestressed against the sheet piles. Excavation continues to the subgrade while lagging and, if required, more tiebacks are installed. A final layer of poured concrete is provided to form the finished, permanent retaining wall.

As shown in U.S. Pat. No. 4,561,804, vertically disposed sheet piles are driven into the ground mass to support the cut in a tied back wall system. While this construction method may be effective in ground formations containing soft soil or soil-like material, it is entirely inapplicable to a ground formation containing cobbles, boulders, rock, weathered rock, or cemented soil. The installation of vertical piling is not practical in these applications because the piling cannot easily be driven into the rock-hard ground formation.

Tied Back Element Walls (TE Wall)

A tied back element wall (TE wall) similarly uses a plurality of tiebacks. In a TE wall, the force necessary to support the side of an excavation is applied to the tieback by testing and prestressing it against retaining elements disposed along the exposed face of the soil mass. This method consists of the following steps:

- excavating the ground from the top down in successive sections;
- applying a layer or layers of pneumaticaily applied concrete to help support the exposed face of the excavated section of the ground;
- positioning retaining elements along the exposed face of the ground;
- installing tiebacks through the retaining elements and into the ground mass;
- testing and prestressing the tiebacks against the retaining elements; and
- repeating the above steps as needed until the entire wall is constructed.

TE walls are sometimes advantageous in that they do not require the installation of soldier beams. However, a TE wall construction is often more costly because the use of tiebacks is not optimized. A TE wall frequently requires between ten and thirty percent more tiebacks than a tied back wall using soldier beams. The additional tiebacks are necessary because the pneumatically applied concrete will not provide adequate support for the exposed slope face across great distances.

Further, TE walls constructed in ground formations containing cobbles, boulders, rock, weathered rock, or cemented soils frequently have an irregular surface. This irregular surface results from the inability to excavate a neat vertical cut in these types of ground formations. An irregular wall surface makes the installation of a permanent wall facing difficult and costly. Indeed, it is very difficult to attach a permanent face to the numerous discrete elements of the TE wall.

Soil Nail Walls

Soil nailing is another method which is used to retain the ground formed adjacent to an excavated slope. Soil nailing methods use untensioned tendons in grout-filled holes drilled into the exposed face of the excavated section of the ground. Soil nailing is often preferred over the above-mentioned tied back walls because soldier beams and timber lagging are not required. Soil nailing is often preferred over the above-mentioned tied back element wall because it is somewhat easier to attach a permanent concrete face to a soil nailing wall. This technique is thus less costly. In a soil nail wall, an array of nearly horizontal reinforcement rods (soil nails) are installed in the ground mass as the excavation proceeds downwardly. A reinforced layer of pneumatically applied concrete is used to support the exposed face between the soil nails. This method consists of the following steps:

- excavating the ground from the top down in successive sections;
- applying a layer or layers of pneumatically applied concrete to help support the exposed face of the excavated section of the ground;
- installing a row of soil nails through the pneumatically applied concrete into the ground mass; and
- repeating the above steps as needed.

U.S. Pat. Nos. 3,638,435; 3,802,204 and Re. 28,977 are exemplary of such a soil nail system. Two layers of pneumatically applied concrete are used to form an outer skin for an exposed slope wall. Boreholes extend through the skin and into the ground adjacent the wall. The boreholes are filled with grout and a reinforcing rod (soil nail) is then installed in the hole before the grout sets to form a dowel. One end of the rod (soil nail) extends outwardly from the skin to facilitate securing the dowel to the outer wall. In one embodiment, the rod (soil nail) is secured to the shotcrete skin itself via a bearing plate and fastener. In a second embodiment, the area surrounding the exposed end of the rod (soil nail) is filled with shotcrete to form a wale beam. The end of the rod (soil nail) is then secured to this shotcrete wale beam with the bearing plate and fastener arrangement.

As shown by the above patents, a soil nail wall depends upon a large number of untensioned dowels and a thin shotcrete face to support the entire excavated cut. Soil nailing is an economical earth retaining method for temporary and permanent applications in ground formations only where the nail holes may be drilled easily. Similarly, permanent soil nail walls are economical to construct only in soft ground formations where a neat vertical excavation can be made. Otherwise, as discussed above with respect to TE walls, the irregular surface makes the installation of a permanent wall facing difficult and costly.

U.S. Pat. No. 5,002,436 describes a retaining wall system which is comprised of a soil nail wall which is faced with pre-cast concrete panels. The facing panels are connected to the exposed ends of the soil nails via an adjustable coupling means. Backfill is then placed in the space between the exposed face of the excavation and the facing panels. This configuration is disadvantageous in several respects. First, the facing panels must necessarily be placed upon one another, and thus the completed outer wall must be vertical. Second, the required panel to soil nail connection significantly increases the overall cost of the retaining wall system. Finally, the panel to soil nail connection is embedded in backfill material and thus prone to deterioration from exposure to the environment.

Tieback Element and Soil Nail Walls (TEN Walls)

The TEN wall is a combination of the above-described tied back element and soil nail methods. A TEN wall is made up of a plurality of tiebacks, retaining wall elements and soil nails. This method utilizes short soil nails and pneumatically applied concrete to temporarily support a section of the soil wall to a certain depth. At some point of the excavation, when further support becomes necessary to retain the ground, a row of tiebacks is added. The soil nails and concrete support the ground between tied back elements, and both soil nails and tiebacks support over all the excavated face. Thus, shorter soil nails and tiebacks are required for the completed structure than in a wall built with only soil nails or tiebacks. This method consists of the following steps:

excavating the ground from the top down in successive sections;

applying a layer or layers of pneumatically applied concrete to help support the exposed face of the excavated section of the ground;

installing soil nails through the pneumatically applied concrete and into the ground mass;

positioning retaining elements along the exposed face of the wall;

installing tiebacks through the retaining elements and into the ground mass;

testing and prestressing the tiebacks against the retaining elements; and repeating the above steps as needed.

In the above described TEN wall method, both the soil nails and the tiebacks form a part of the final retaining wall support structure. The ultimate strength of the retaining wall will thus depend entirely on the strength of the soil nails and tiebacks themselves. No further reinforcement to the retaining wall structure is provided. The TEN wall is further subject to the limitations of the TE wall and soil nailing methods in that an irregular wall surface is formed.

Prior Art VSL Retaining Wall Methods

Other earth retaining wall systems and methods exist in the prior art which do not use vertically drilled piles or soldier beams. One such prior art method is shown at page 9 (bottom right photograph) of the "Soil and Rock Anchors" brochure published by the VSL Corporation. This method uses tied back vertical beams of cast-in-place concrete as support for an excavated face. These vertical beams are cast-in-place along the excavated face as the excavation proceeds downwardly. Tiebacks are installed through the vertical beams, and reinforcing steel extends from these beams. A cast-in-place face is then applied to the retaining wall and tied to the steel reinforcements protruding from the vertical beams. Walls built with vertical beams in this manner are difficult to construct because the vertical beams have to be built in short segments as the excavation proceeds, resulting in numerous reinforcing bar splices. Vertical beams are more expensive to build than horizontal beams since the concrete has to be placed using a concrete pump or with a concrete bucket and a crane. Vertical beam walls will require the tiebacks to be installed as the excavation proceeds rather than at their optimum location. Vertical beam walls are applicable for locations where the ground will support itself during construction. Attachment of precast concrete wall panels to vertical beams constructed against an excavated face is difficult and expensive since the front face of the beams must be at the proper location in order to allow the precast to be attached. Such vertical beam walls are relatively high and require long precast panels which are heavy and difficult to ship and handle.

A second prior art retaining wall method which does not use vertically drilled piles or soldier beams is described at page 11 of the VSL Newsletter published by the VSL Corporation. With this method, an excavated cut is made in successive sections from the top down. Each section is fully faced with reinforced cast-in-place concrete panels. These concrete panels are then secured to the exposed slope face via tiebacks. This method of construction is undesirable for ground formations containing rock or rock-like material since the integrity of a completed section of panels is undermined when the excavation of a section therebelow is commenced. In addition, this system is extremely expensive because the entire slope face must first be covered with cast-in-place panels and an additional outer face applied subsequently.

Also shown at page 9 (top photograph) of the VSL Corporation brochure entitled "Soil and Rock Anchors" is a third prior art retaining wall construction method which does not use soldier beams. With this method, horizontal concrete tie-beams and tiebacks are used to support an excavation made in a rock formation. However, this particular configuration is suitable only where the ground formation between the tie-beams is capable of supporting itself or where the cut face may be flattened to achieve a stable face. This system does not teach the facing of the horizontal tie-beams, nor is vertical support provided.

Other Prior Art Retaining Wall Methods

Another prior art retaining wall method utilizes soil nails and a layer or layers of pneumatically applied concrete to temporarily support the ground behind the earth retaining wall. Tiebacks are also installed, and a permanent outer concrete wall is poured and cured or attached. This method consists of the following steps:

- excavating a soil wall from the top down in successive sections;
- applying a layer or layers of pneumaticaily applied concrete to help support the exposed face;
- installing soil nails through the pneumaticaily applied concrete layer or layers and into the soil mass;
- installing tiebacks through the pneumaticaily applied concrete layer or layers and into the soil mass;
- repeating the above steps as needed;
- attaching or pouring and curing an outer layer of concrete; and
- testing and prestressing the tiebacks against the outer layer of concrete.

With this method, the tiebacks are tested and prestressed against the final outer layer of poured concrete. Because the tiebacks are not tested and prestressed until the final outer wall is poured and cured, the tiebacks either visibly protrude through the completed wall or the wall must be patched at each tieback location. In either case the wall is unattractive.

U.S. Pat. No. 4,911,582 discloses a further prior art method which utilizes a concrete replacement wall to strengthen, repair or replace an existing earth retaining wall. In this method, tiebacks are installed through the exposed face and into the soil mass. Preferably, the tiebacks are installed in an open area of the existing wall which is filled with concrete. The tiebacks are then tested and prestressed against an anchorhead assembly placed against the existing wall. Finally, an outer concrete wall is cast in place over the entire exposed face of the wall. The outer wall is reinforced with a grid of reinforcing bars, which is positioned before the concrete wall is cast. Alternatively, soil nails may be used instead of tiebacks. The method thus consists of the following steps:

- installing tiebacks (or soil nails) through an existing retaining wall and into the ground mass;
- testing and prestressing the tiebacks against the existing retaining wall; and
- pouring a concrete wall over the existing retaining wall and the exposed end of the tiebacks.

The above-described method is specifically designed for shoring up an existing retaining wall, not a newly formed embankment. Thus, no excavation takes place and a retaining wall with an outer face is not formed. Rather, the method of U.S. Pat. No. 4,911,582 is directed solely to a concrete replacement wall which is designed to strengthen, repair or replace an existing earth retaining wall.

It can thus be seen that there is a need for an improved method of forming a retaining wall with an outer face. In particular, there is a need for a retaining wall system which may be formed in ground formations containing cobbles, boulders, rock, weathered rock, or cemented soil where the installation of vertical piling is impracticable. Such a retaining wall system must be capable of adequately supporting the excavated cut without the need for soldier beams. In addition, such a retaining wall system must be designed to overcome the disadvantages inherent in existing prior art retaining wall systems by providing a structurally sound retaining wall which is less costly to construct and which has an outer face which is ultimately pleasing to the eye.

SUMMARY OF THE INVENTION

Broadly, the retaining wall system of the present invention is comprised of a retaining wall with an outer face. First, a retaining wall is formed. In this regard, a cut is excavated in successive sections to expose the face of the ground to be retained. If the ground conditions require temporary support, then the exposed cut face of each successively excavated section may be temporarily supported by pneumaticaily applied concrete. If temporary support is used, wire mesh is preferably used to reinforce the pneumaticaily applied concrete. Soil nails may also be used to further shore up the exposed slope face. A concrete wale is then formed horizontally along a portion of the exposed slope face of each successively excavated section. Next, tiebacks are installed through the concrete wale. The tiebacks are tested, tensioned and secured against the concrete wale. These construction steps for the retaining wall are repeated for each successively excavated section of the slope or embankment until the desired depth of the excavation is reached.

After the excavation has been completed and the retaining wall formed, a tiered outer face is provided which extends to the full height of the retaining wall. A concrete footing is first provided at the base of the retaining wall. Next, a first tier of facing elements is erected above the concrete footing. These facing elements are then secured to a first adjacent concrete wale at a first connection point. Backfill material is placed between the first tier of facing elements and the retaining wall. Finally, concrete is placed between the first tier of facing elements and the retaining wall to thereby encase the first connection point.

The outer face is designed to extend to the full height of the retaining wall. Thus, if the size of the particular retaining wall requires such, the outer face may further comprise at least one additional tier of facing elements erected above the first adjacent concrete wale. This additional tier of facing elements is secured to either the first adjacent concrete wale or to the first tier of facing elements at a second connection point. The second connection point and the first adjacent concrete wale are encased in the concrete placed between the first tier of facing elements and the retaining wall. The additional tier of facing elements is also secured to a next adjacent concrete wale at a third connection point. Additional backfill material is then placed between the additional tier of facing elements and the retaining wall. Finally, additional concrete is placed between the additional tier of facing elements and the retaining wall to thereby encase the third connection point.

Still further additional tiers of facing elements may be similarly erected and secured in ascending stages extending to the full height of the retaining wall. Further additional backfill material and further additional concrete fill is then similarly placed between the retaining wall and each further additional tier of facing elements. The outer face thus effectively ties together the concrete wales and tiebacks of the retaining wall to further support the excavated slope.

An additional aspect of the present invention is the provision of vertical load bearing members. In one embodiment, these load beating members comprise a plurality of elongated posts. At least one elongated post extends between the first adjacent concrete wale and the base of the retaining wall. Additional elongated posts are disposed between adjacent concrete wales extending along the face of the retaining wall. These posts thus transmit the vertical component of force associated with the tiebacks and the weight of the system to subgrade. Importantly, unlike prior art piling or soldier beam constructions, the vertical posts of the present invention are not placed until after the slope has been excavated and the retaining wall formed. With the prior art methods, the drilling of vertical pilings or soldier beams is often impracticable in ground formations containing cobbles, boulders, rock, weathered rock, or cemented soil. By contrast, erection of the posts of the present invention is unhindered even when the retaining wall system is practiced in difficult ground formations.

In an alternative embodiment of the present invention, the vertical load bearing members comprise mini-piles installed in a drilled hole behind the face of the cut.

The present invention overcomes many of the disadvantages of the prior art retaining wall systems. Initially, the present invention overcomes the disadvantages associated with the tied-back wall method because no vertical pilings or soldier beams need be installed. Rather, pneumatically applied concrete may be used to temporarily shore up the embankment, and tiebacks and concrete wales are used to form the retaining wall. An outer face is then erected which effectively ties together the concrete wales and tiebacks of the retaining wall to further support the excavated slope. Additional vertical reinforcement is provided in the present invention by elongated reinforcement posts which extend between adjacent wales. These posts are placed only after the excavation has been completed and the retaining wall formed. In providing for a structurally sound retaining wall without using vertically drilled piling, the present invention may thus be used to face excavations in areas with ground formations containing cobbles, boulders, rock, weathered rock, or cemented soil.

The present invention also overcomes many of the disadvantages of the TE wall. In a TE wall, a great number of tiebacks must be used because the pneumatically applied concrete will not provide adequate support across a wide area of the slope face. The present invention utilizes a wale which allows the tiebacks to be located at their optimum spacing thus reducing the number of tiebacks. The addition of the vertical load bearing member allows the tiebacks to be installed at a steeper angle which is often advantageous. Further, the installation of the facing elements is easier with the present invention than with the TE wall.

The present invention is similarly superior to the prior art soil nailing methods. The method of the present invention is less expensive than soil nailing for temporary and permanent applications in ground formations where the nail drilling is expensive because it requires approximately 33 percent less drilling. The present invention also overcomes the disadvantages associated with the irregularly shaped wall surface formed with the soil nailing methods since the installation of facing elements is much easier in the TE wall The present invention also presents numerous advantages to the construction method shown in U.S. Pat. No. 5,002,436. In particular, the outer face of the present invention may be configured in a variety of orientations other than vertical since the facing elements need not be stacked directly upon one another. Also, the connection of the facing elements to the wales and to one another is less complex and costly than that shown by U.S. Pat. No. 5,002,436. Finally, the facing element and soil nail connections of the present invention are advantageously embedded within concrete material, and thus are protected from deterioration due to exposure to the environment.

The present invention also overcomes disadvantages associated with the prior art TEN wall method. With the TEN wall, both soil nails and tiebacks are used to form a final retaining wall support structure. With the present invention, soil nails are not necessarily required. Rather, temporary support if required may be provided by pneumatically applied concrete alone, while the retaining wall itself is formed by the tiebacks and the concrete wales. Soil nails, if used, provide only temporary support to shore up the exposed slope face. By contrast, soil nails are necessary in the prior art TEN walls to provide adequate permanent support across the face of the slope to the ultimate depth of the excavation. With the present invention, the need for soil nails is obviated by the erection of an outer face and by the provision of additional support via the elongated vertical posts. The prior art TEN walls fail to provide for vertical support as in the present invention.

Notably, the prior art TEN walls include no outer face whatsoever. Rather, the exterior surface of the prior art TEN walls is comprised of pneumatically applied concrete, retaining elements, and exposed tiebacks and soil nails. Thus, unlike the present invention, the prior art TEN walls fail to include an outer face made up of a plurality of facing elements effectively tied to the retaining wall to present an attractive exterior surface.

The present invention is similarly superior to the various VSL construction methods discussed above. The present invention is superior to the vertical beam method since it allows the beams to be cast horizontally without reinforcing bar splices and expensive concrete placing methods. Also, the location of the back face of the finished wall does not require the horizontal beams to be installed along the precise alignment of the wall, i.e., the horizontal beams of the present invention may move in and out of the slope. Further, with the present invention, the tiebacks may be placed at their optimum locations, and the wall may be economically built in ground which requires support during construction. Finally, the present invention uses relatively short tiered precast panels which are cheaper to manufacture and easier to ship and handle than the large panels required by this prior art method.

Further, as noted above, the second VSL method is highly undesirable for ground formations containing cobbles, boulders, rock, weathered rock, or cemented soil because the integrity of a completed retaining wall section is undermined by the commencement of the excavation of a section therebelow. The second VSL method is also extremely expensive because the entire slope face must first be covered with cast-in-place panels and an additional outer face applied subsequently.

The third VSL retaining wall construction method discussed above is suitable only for ground formations with certain characteristics. Unlike the present invention, no outer face is provided with this method, and the wall is suitable for use only where the ground formation between the tie-beams is capable of supporting itself or where the cut face may be flattened to achieve a stable face. The present invention, on the other hand, incorporates an outer face made up of a plurality of facing elements disposed between horizontal concrete wales which further support the excavated slope. Thus, the present invention is suitable for use with ground formations other than those containing entirely solid rock or rock-like material.

As discussed above, the method of U.S. Pat. No. 4,911,582 is specifically designed for use with an existing retaining wall. Hence, since no excavation takes place, this method does not provide for the temporary shoring up of an excavated slope or the formation of a specific retaining wall. The present invention, on the other hand, is specifically designed to provide a retaining wall with an outer face to support a newly excavated cut in the ground.

In the remaining retaining wall method discussed above, the tiebacks are tested and prestressed against the final outer concrete wall. Thus, the ends of the tiebacks visibly protrude through the completed wall. The present invention, on the other hand, places concrete wales along the face of the retaining wall so that each tieback can be tested and prestressed before the outer face is provided. In this manner, the tiebacks of the present invention are not visible in the completed retaining wall structure. The resulting retaining wall system with facing elements has a smooth exterior surface which is attractive and more pleasing to the eye.

BRIEF DESCRIPTION OF THE DRAWINGS

The novel features of the invention are set out with particularity in the appended claims, but the invention will be understood more fully and clearly from the following detailed description of preferred embodiments of the invention as set forth in the accompanying drawings, in which:

DETAILED DESCRIPTION OF THE INVENTION

The present invention is directed to a retaining wall system and method. Prior art tiedback retaining walls for retaining an earth mass during excavation typically incorporate vertical structural members such as steel soldier beams or reinforced concrete piers. After the vertical members are in place, tiebacks are used to provide horizontal restraint for the vertical members. These vertical members are installed by either driving with percussion or vibratory hammers in the case of H-beams, or by inserting the steel or reinforced concrete in a predrilled hole in the ground. In ground formations which contain cobbles, boulders, cemented soil, weathered rock, or rock, the installation of vertical members is difficult and expensive. The present invention eliminates the need for the installation of vertical members through difficult ground formations. Broadly, the retaining wall system is comprised of a retaining wall and an outer face. This retaining wall system is particularly well-suited for use with ground formations containing cobbles, boulders, cemented soil, weathered rock, or rock. A typical application for the retaining wall system of the present invention is to support newly formed slopes or embankments in such ground formations alongside roadways.

Figure 1:
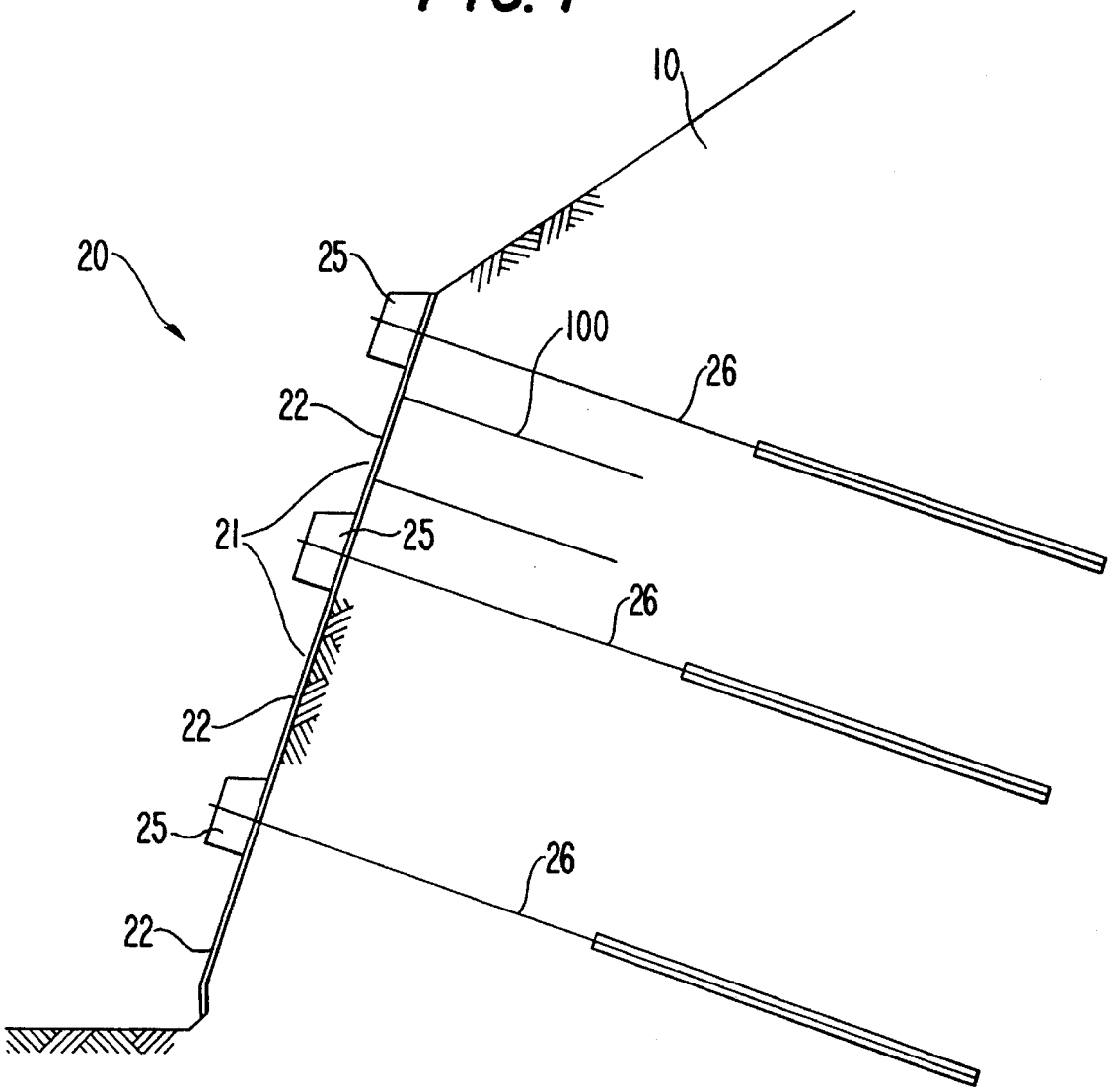
FIG. 1 is a sectional view of the retaining wall utilized in the retaining wall system of the present invention.
Figure 8:
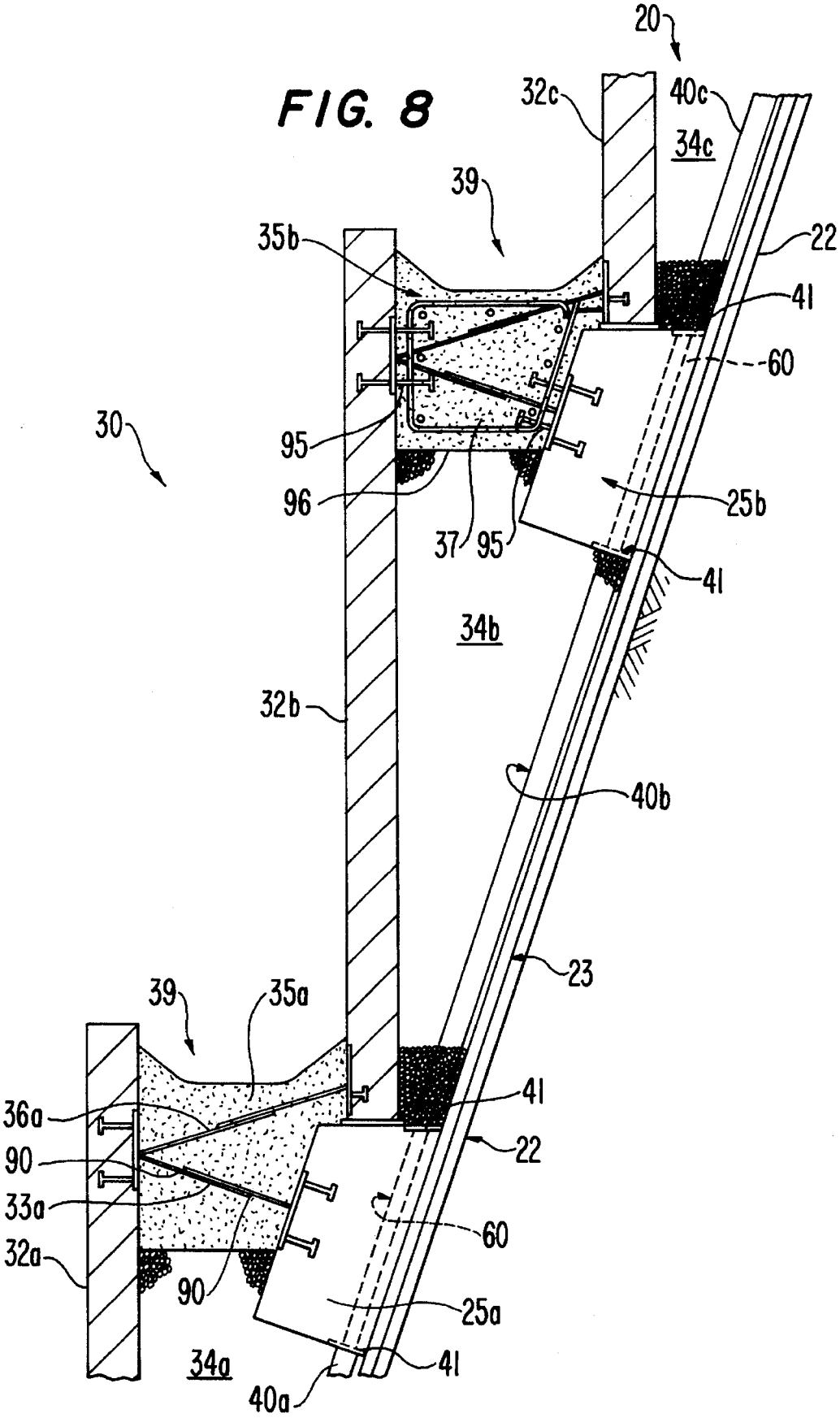
FIG. 8 is a partially broken away sectional view showing the area of the connection of the retaining wall and outer face of the retaining wall system of the present invention in greater detail.
Figure 10:
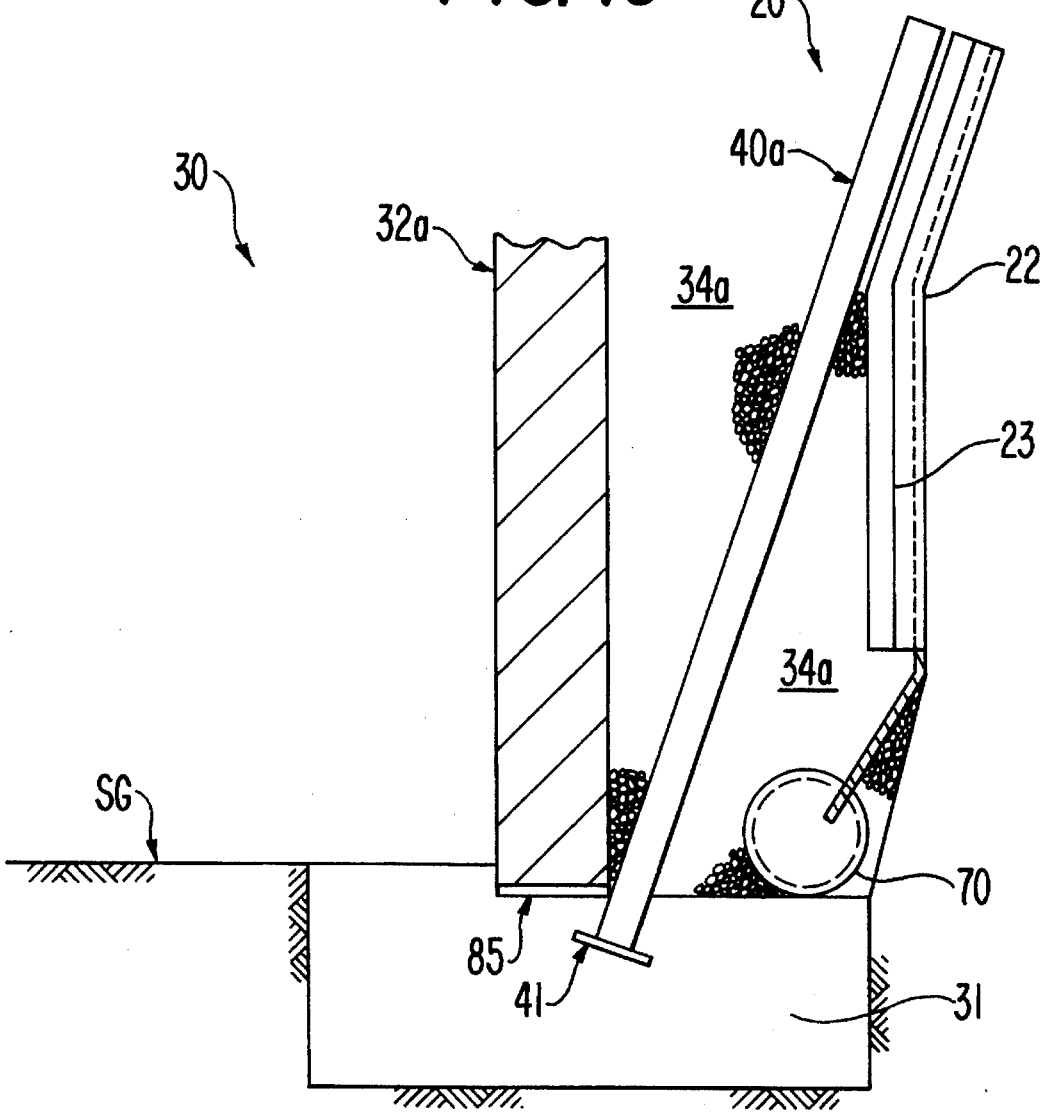
FIG. 10 is a partially broken away sectional view showing the retaining wall system of the present invention at the subgrade level.

A retaining wall (20) formed in accordance with the retaining wall system of the present invention is shown generally in FIG. 1. In forming the retaining wall (20), an existing ground formation (10) is excavated in successive sections to form newly exposed cut faces (21). For example, three successively excavated sections are shown in FIG. 1 to form an excavated face in the ground to a desired depth. As the excavation proceeds, the exposed cut face (21) of each successively excavated section may be temporarily supported with pneumatically applied concrete (22). In cuts formed in strong ground formations, the exposed cut faces (21) may not require temporary support. However, in areas where the exposed slope faces (21) are comprised in whole or in part of loose soil or loose rock, temporary support of the face (21) while the excavation proceeds may become necessary. If so, the slope face (21) may be temporarily supported with conventional pneumatically applied concrete (22), such as shotcrete, gunite, or fiber reinforced pneumatically applied concrete. Most preferably, if temporary support is required, wire mesh (23) is placed within the pneumatically applied concrete (22) to provide reinforcement as shown in FIGS. 8 and 10. In addition, soil nails (100) may also be used to further support the exposed cut face.

Once the depth of an excavated section has been reached, and, if required, after temporarily supporting the exposed cut face (21), a concrete wale (25) is then formed. Each wale (25) extends substantially horizontally along a portion of the exposed slope face (21) of each successively excavated section. The wales (25) may be formed from cast-in-place reinforced concrete, pre-cast reinforced concrete, cast-in-place post-tensioned concrete, or other suitable material. Next, tiebacks (26) are installed through the concrete wale (25). The particular tiebacks (26) utilized may be of any suitable conventional tendon or rod configuration, such as those fabricated in accordance with the Specifications for Permanent Ground Anchors of the AASHTO-AGC-ARTBA Joint Committee, Task Force 27 Report, January 1990. Finally, the tiebacks (26) are tested, tensioned and secured against the concrete wale (25). These construction steps for the retaining wall are repeated for each successively excavated section of the slope or embankment until the desired depth of the excavation is reached.

Figure 2:
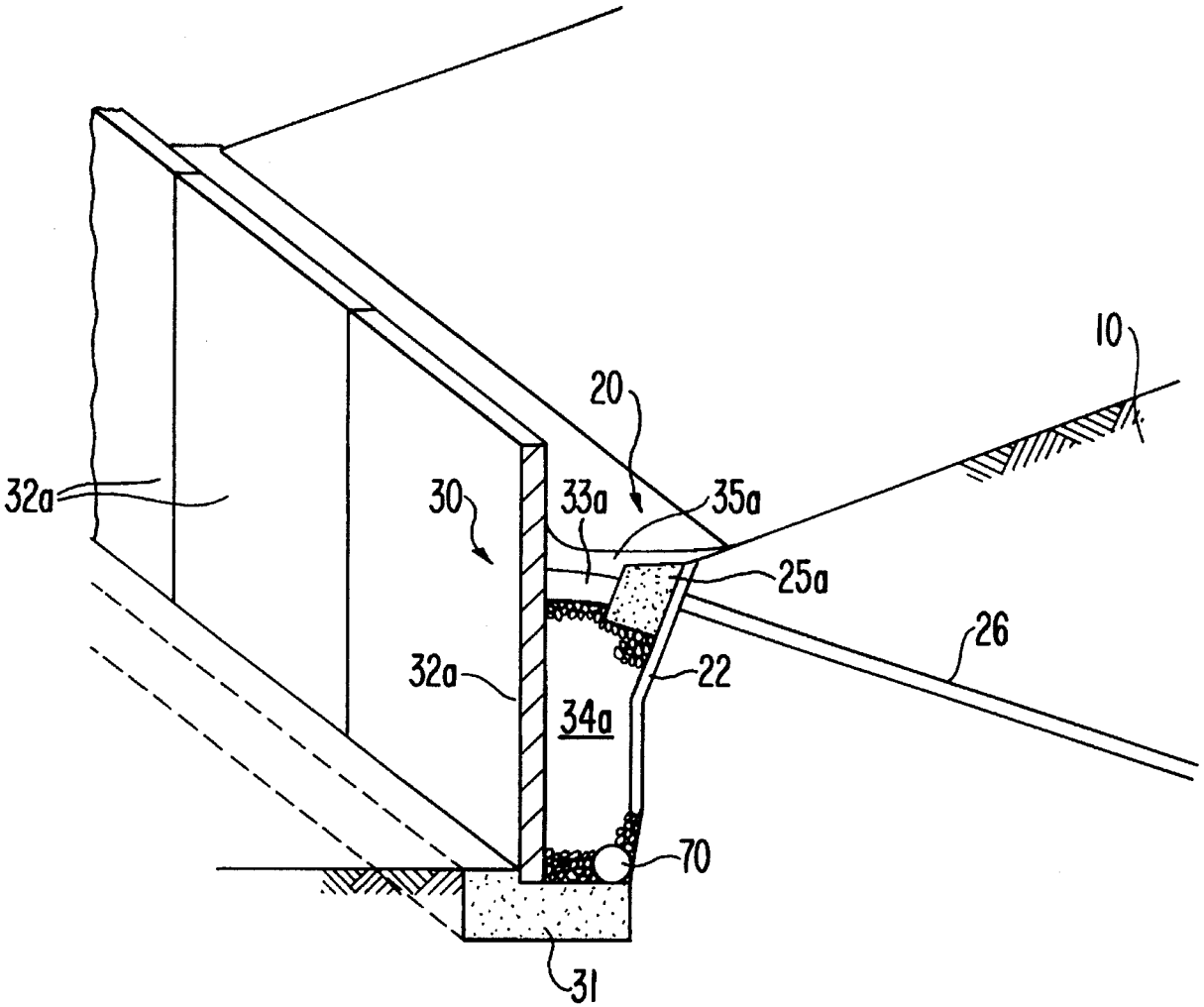
FIG. 2 is a partial perspective view of a first embodiment of the retaining wall system of the present invention showing the retaining wall and outer face.
Figure 3:
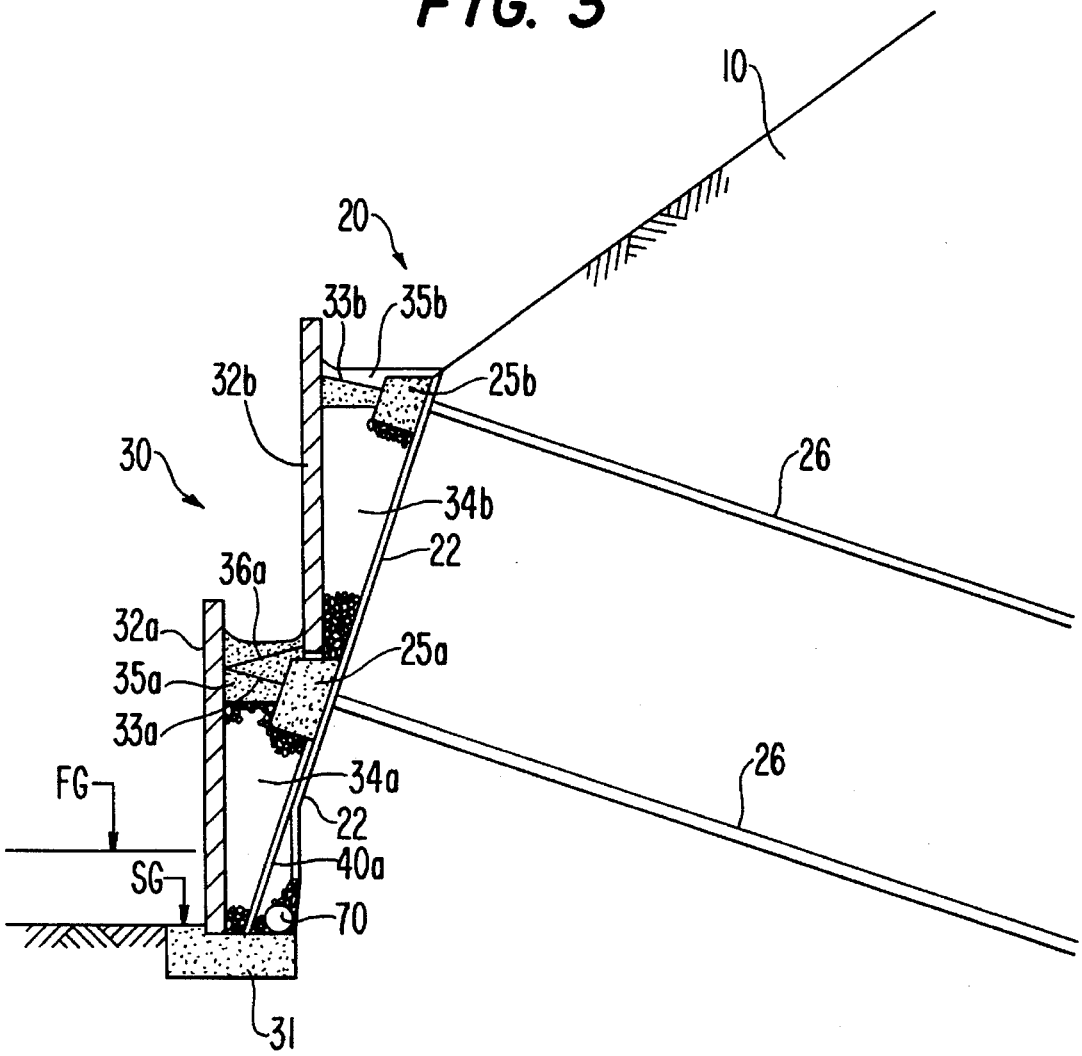
FIG. 3 is a sectional view of a second embodiment of the retaining wall system of the present invention showing the retaining wall and outer face.

As shown in FIG. 2, once the excavation has reached the desired final depth and the retaining wall (20) has been completed, an outer face (30) is provided which extends to the full height of the retaining wall (20). A concrete footing (31) is first provided at the base of the retaining wall (20). As shown in FIG. 3, if the retaining wall system of the present invention is utilized alongside a roadway, this concrete footing (31) will be formed at the subgrade level (SG), somewhat below the finished grade (FG) of the roadway surface.

Next, a first tier of facing elements (32*a*) is erected above the concrete footing (31). The facing elements (32*a*) may be formed from pre-cast concrete panels, masonry, gabions, or other suitable construction elements. As shown in FIG. 2, these facing elements (32*a*) are secured to a first adjacent concrete wale (25*a*) by a connector (33*a*). Backfill material (34*a*) is then placed between the first tier of facing elements (32*a*) and the retaining wall. Preferably, the backfill material (34*a*) is a free-draining granular material. Finally, concrete (35*a*) is placed between the first tier of facing elements (32*a*) and the retaining wall (20) to thereby encase the tieback (26) connection to the wale (25*a*) and the connector (33*a*).

As shown in FIG. 2, connector (33*a*) thereby secures the first tier of facing elements to the retaining wall. This connector may take any of a number of conventional forms which will be fully appreciated by those skilled in the art. For example, as shown more clearly in FIG. 8, the connector may comprise a plurality of overlapping plates (90) which extend from the first tier of panels (32*a*) and from the wale (25*a*), and which are welded together in a conventional manner. This welded connection is then encased in the concrete (35*a*). As discussed more fully below, this encasement of the connection is highly advantageous. A further potential connector configuration (37) is shown in FIG. 8 in the area of the next adjacent concrete wale (25*b*). With this arrangement, a plurality of studs or hook bars (95) extend from the wale (25*b*) and from the additional tier of facing elements (32*b*). Additional steel reinforcement (96) is provided, and the concrete (35*b*) is poured to form a connector comprised of reinforced concrete.

The outer face (30) is designed to extend to the full height of the retaining wall (20). Thus, as shown in FIG. 3, if the size of the particular excavation and retaining wall (20) require such, the outer face (30) may further comprise at least one additional tier of facing elements (32*b*) erected above the first adjacent concrete wale (25*a*). This additional tier of facing elements (32*b*) is secured to the first tier of facing elements (32*a*) by a connector (36*a*), the connector (36*a*) and the connector (33*a*) being encased in the concrete (35*a*) placed between the first tier of facing elements (32*a*) and the retaining wall (20). The additional tier of facing elements (32*b*) is also secured by connector (33*b*) to a next adjacent concrete wale (25*b*) located above the first adjacent concrete wale (25*a*). Additional backfill material (34*b*) is then placed between the additional tier of facing elements (32*b*) and the retaining wall (20). Finally, additional concrete (35*b*) is placed between the additional tier of facing elements (32*b*) and the retaining wall (20) to thereby encase the third connection point (33*b*). Connector (36*a*) may take any of a number of conventional forms as discussed above with respect to FIG. 8 and connector (33*a*). That is, connector (36*a*) may be formed from welded plates encased in the concrete (35*a*), or a plurality of studs or hooks and reinforcing steel may be provided such that the connector (36*a*) is comprised of reinforced concrete.

Figure 12:
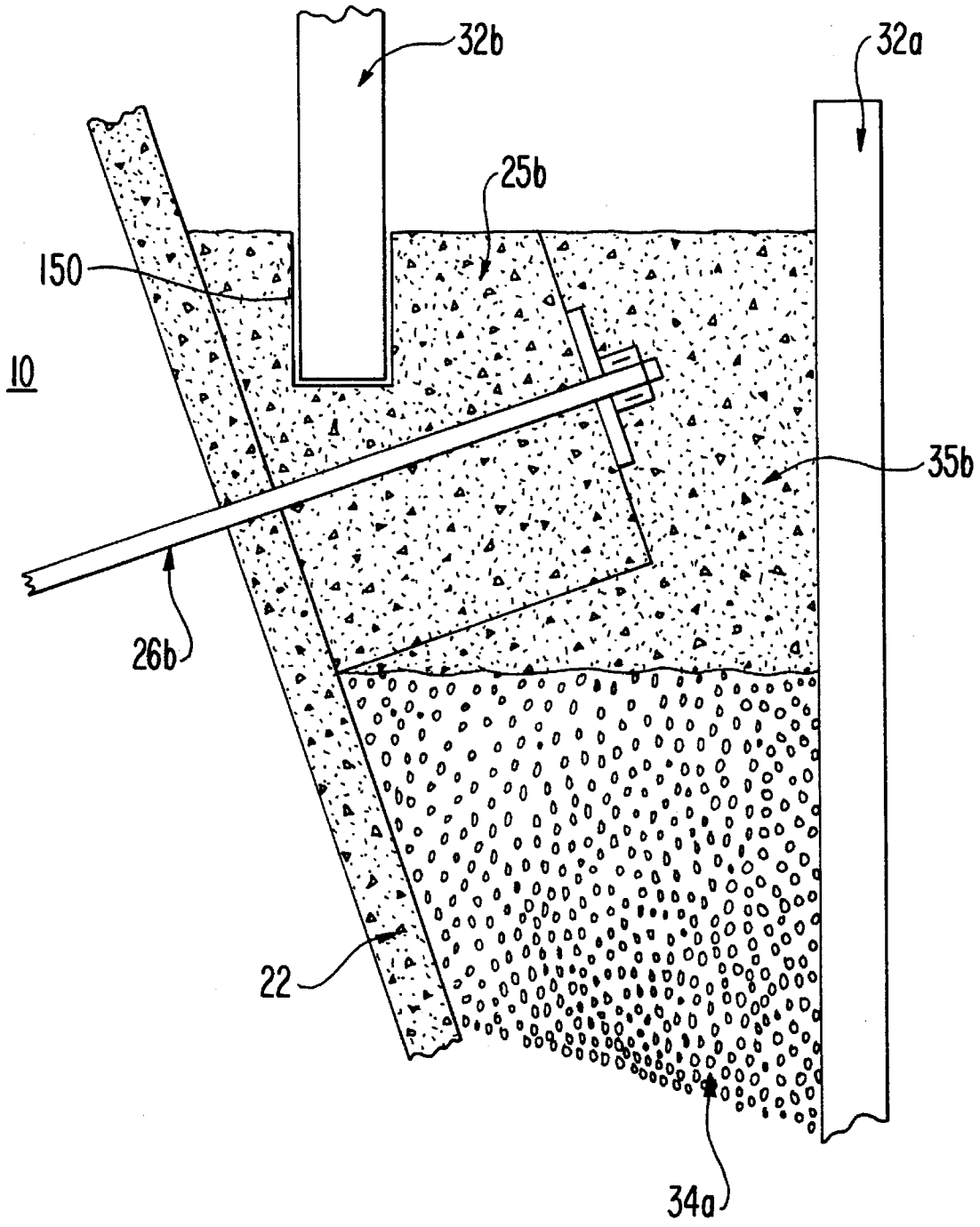
FIG. 12 is a partially broken away sectional view showing a further alternative embodiment of the facing element and wale connection of the present invention in greater detail.

FIG. 12 illustrates an alternative embodiment of the present invention wherein the additional tier of facing elements (32*b*) is secured to the first adjacent concrete wale (25*a*) rather than to the first tier of facing elements (32*a*). The additional tier of facing elements (32*b*) is received in and secured by a recessed area (150) of the first adjacent concrete wale (25*a*).

Figure 4:
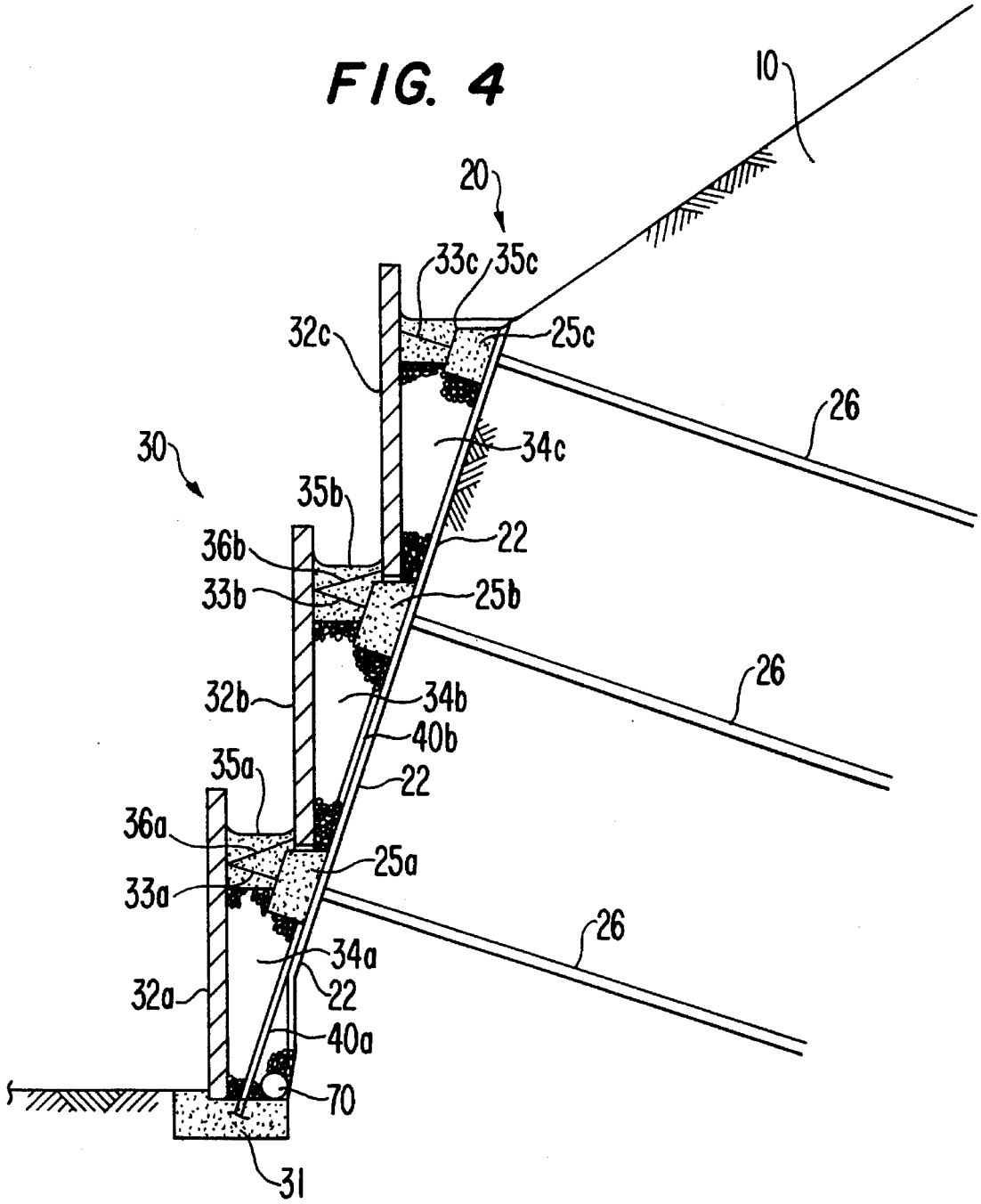
FIG. 4 is a sectional view of a third embodiment of the retaining wall system of the present invention showing the retaining wall and outer face.
Figure 5:
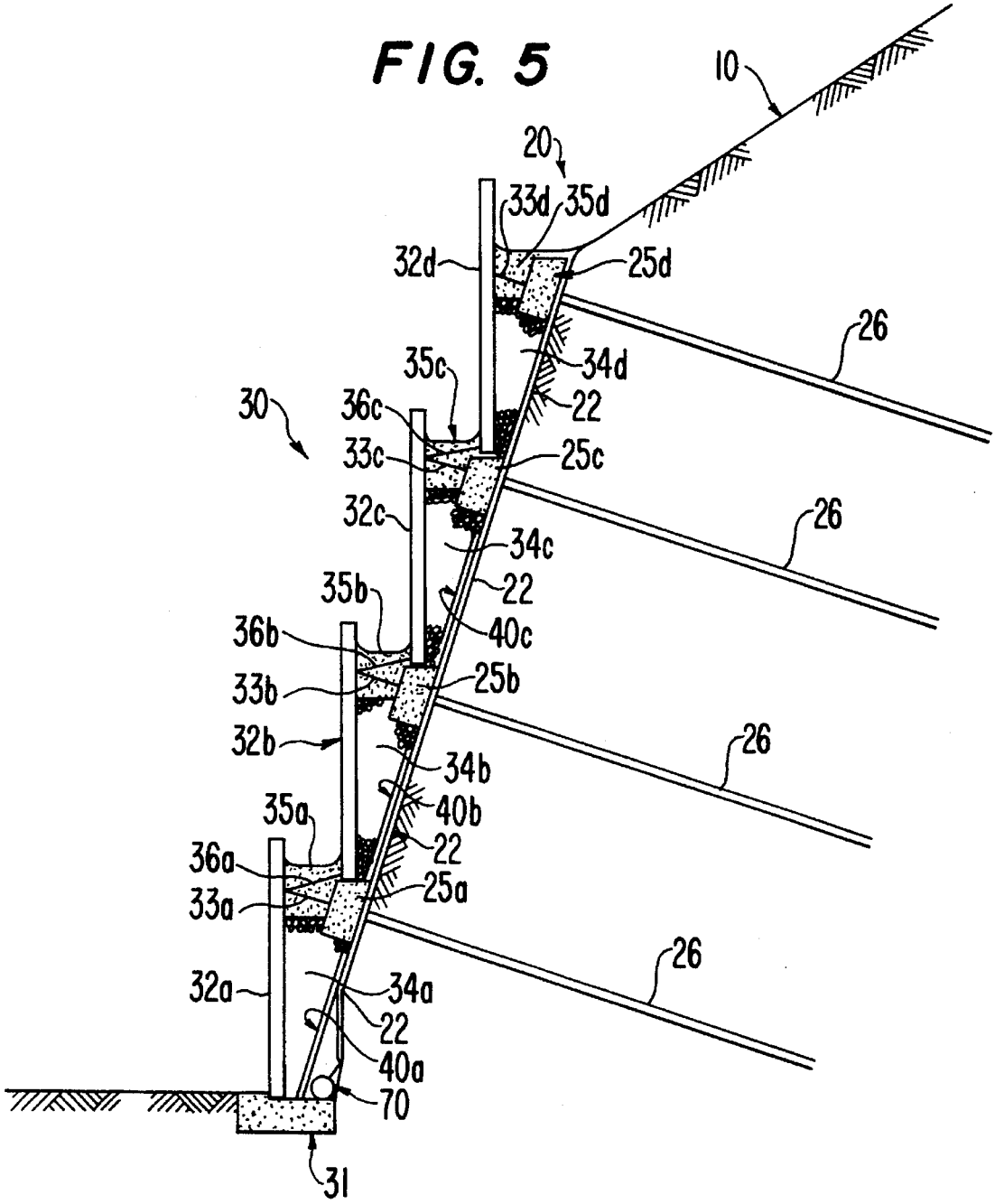
FIG. 5 is a sectional view of a fourth embodiment of the retaining wall system of the present invention showing the retaining wall and outer face.

FIGS. 4 and 5 show embodiments of the present invention utilizing further additional tiers of facing elements similarly erected and secured in ascending stages extending to the full height of a retaining wall (20). In FIG. 4, a further additional tier of facing elements (32*c*) is erected above the next adjacent concrete wale (25*b*). This further additional tier of facing elements (32*c*) is secured to the tier of facing elements (32*b*) therebelow by connector (36*b*), the connector (36*b*) and connector (33*b*) being encased in the concrete (35*b*) placed between the tier of facing elements (32*b*) therebelow and the retaining wall (20). The further additional tier of facing elements (32*c*) is also secured to a next adjacent concrete wale (25*c*) by connector (33c). Additional backfill material (34*c*) is then placed between the further additional tier of facing elements (32*c*) and the retaining wall (20). Finally, additional concrete (35*c*) is placed between the additional tier of facing elements (32*c*) and the retaining wall (20) thereby encasing the connector (33*c*).

FIG. 5 shows a still further additional tier of facing elements (32*d*) for a retaining wall of a greater height. In FIG. 5, a still further additional tier of facing elements (32*d*) is erected above the next adjacent concrete wale (25*c*). This further additional tier of facing elements (32*d*) is secured to the tier of facing elements (32*c*) therebelow by connector (36*c*), the connector (36*c*) and connector (33*c*) being encased in the concrete (35*c*) placed between the tier of facing elements (32*c*) therebelow and the retaining wall (20). The still further additional tier of facing elements (32*d*) is also secured to a next adjacent concrete wale (25*d*) by connector (33*d*). Additional backfill material (34*d*) is then placed between the still further additional tier of facing elements (32*d*) and the retaining wall (20). Finally, additional concrete (35*d*) is placed between the additional tier of facing elements (32*d*) and the retaining wall (20) to thereby encase connector (33*d*).

As can be seen from FIGS. 4–5, the retaining wall system of the present invention may be utilized with an excavation of any desired depth. A cut is merely excavated in successive sections and the retaining wall suitably formed in stages along each successively exposed slope. Once the desired depth is reached and the retaining wall is complete, an outer face is formed by erecting successive tiers of facing elements in ascending stages until the full height of the retaining wall is reached.

Figure 6:
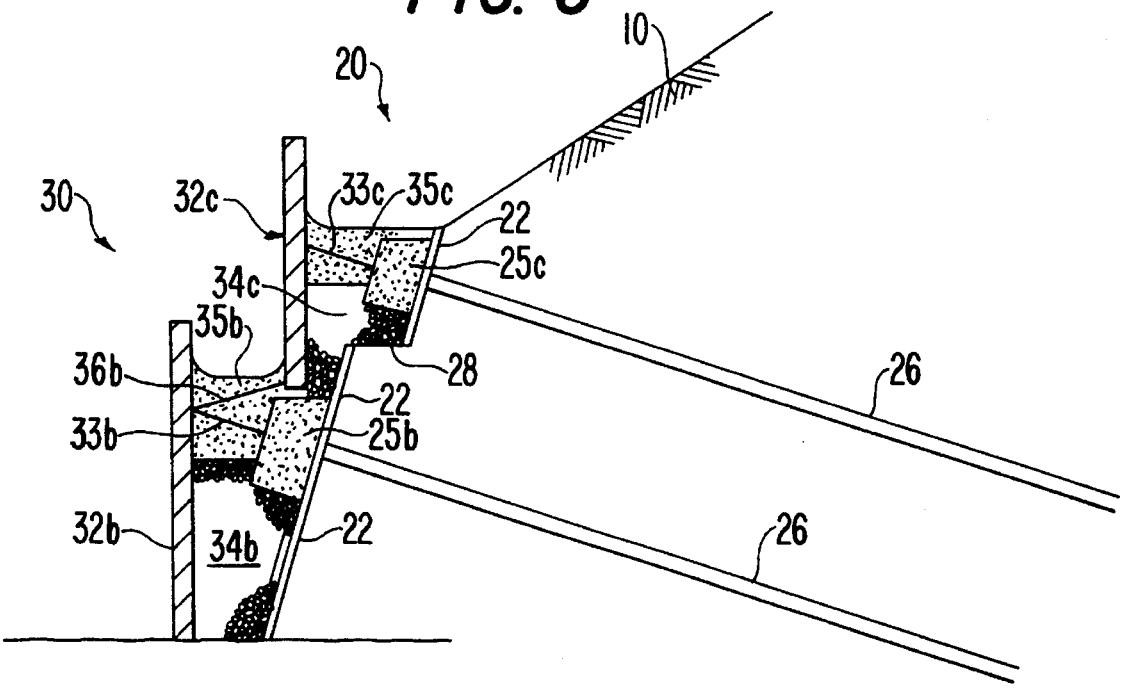
FIG. 6 is a partially broken away sectional view of a fifth embodiment of the retaining wall system of the present invention showing the retaining wall and outer face.

FIG. 6 shows a partially broken away sectional view of a further alternative embodiment of the retaining wall system of the present invention. This embodiment differs in that the ground formation (10) includes an excavated stepped section such that an exposed horizontal shelf (28) is formed in the face of the cut. In all other respects, the retaining wall and outer face are essentially formed in accordance with the embodiments discussed above. For example, FIG. 6 shows the pneumatically applied concrete (22), tiebacks (26), and concrete wales (25*b*, 25*c*) of the retaining wall (20). In addition, the outer face (30) of this embodiment is shown to include a plurality of tiers of facing elements (32*b*, 32*c*) and the accompanying connectors (33*b*, 33*c*, 36*b*), backfill (34*b*, 34*c*), and concrete encasements (35*b*, 35*c*). The only difference associated with the construction of this embodiment is the provision of additional backfill material (34*c*) in the area above the horizontally formed shelf (28).

Figure 7:
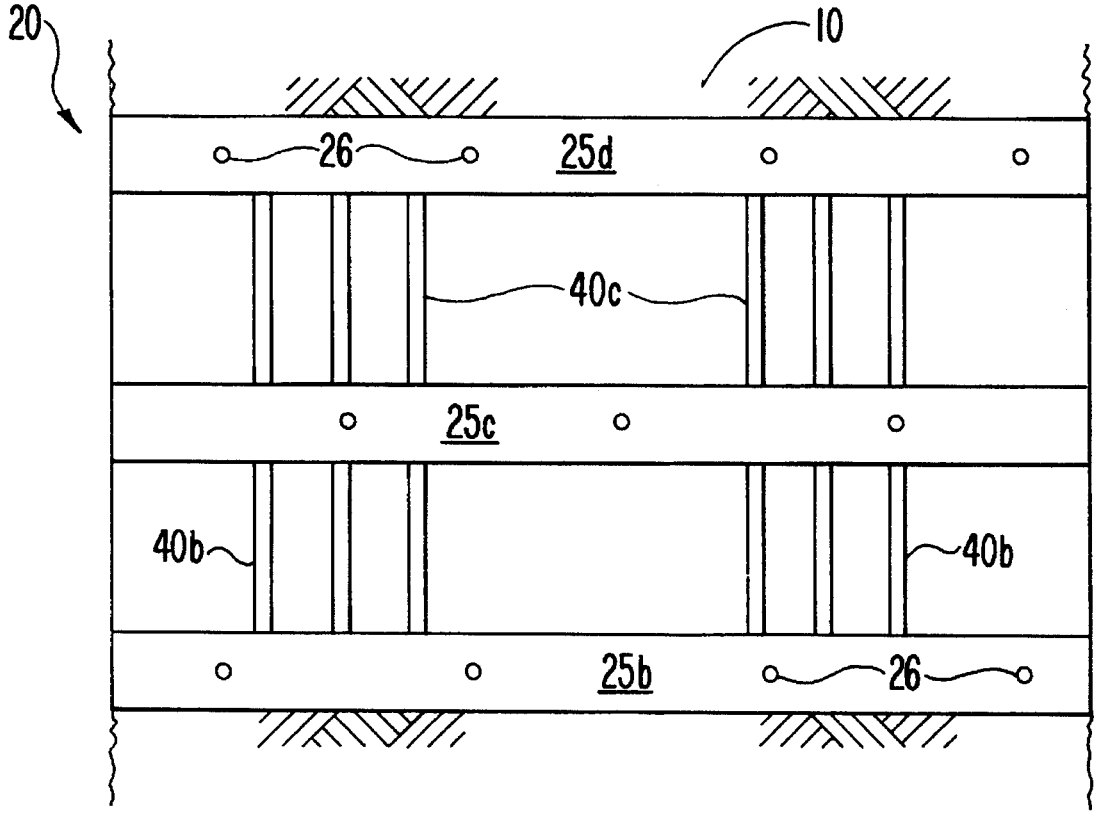
FIG. 7 is a partially broken away view of the cut as seen laterally along the excavation showing the tiebacks and concrete wales of the retaining wall system of the present invention.

An additional aspect of the present invention is the provision of vertical load bearing members. In one embodiment, the vertical load bearing members comprise elongated posts (40). As shown in FIG. 3, elongated posts (40*a*) extend between the first adjacent concrete wale (25*a*) and the footing (31) at the base of the retaining wall (20) at the subgrade level (SG). As shown in FIGS. 4–5, additional elongated posts (40*b*, 40*c*) are disposed between adjacent concrete wales (25*a*, 25*b*, 25*c*) and extend along the face of the retaining wall (20) at locations where further support is desired. FIG. 7 illustrates one possible configuration of the posts (40) as seen laterally along the face of the retaining wall. The posts (40) may be constructed of steel, precast concrete, cast-in-place concrete, pneumatically applied concrete, or any other suitable material. These posts (40) transmit the vertical component of force associated with the tiebacks (26) and the weight of the system to the subgrade level (SG).

The elongated posts (40) are installed after the tiebacks (26) and wales (25) of the retaining wall (20) are in place, but prior to the placement of the outer face (30). Importantly, these posts (40) resist the vertical component of force of the tiebacks and the weight of the system without the need for the installation of piles or soldier beams. Thus, the present invention provides a structurally sound retaining wall system which may be used even in areas of ground formations containing cobbles, boulders, rock, weathered rock, or cemented soil, where the use of piles or soldier beams is impracticable.

Figure 11:
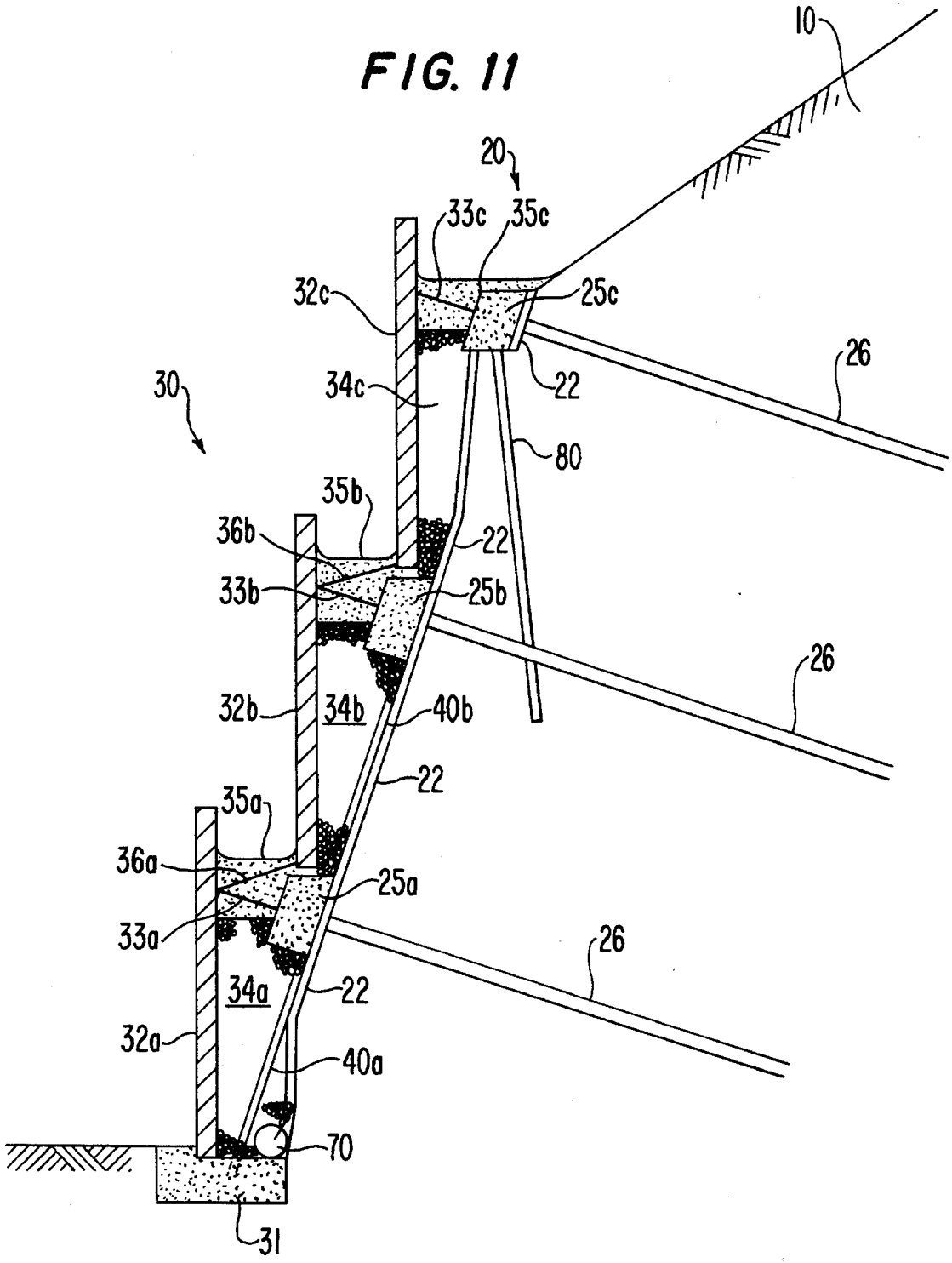
FIG. 11 is a sectional view of a further alternative embodiment of the retaining wall system of the present invention showing the retaining wall and outer face.

In an alternative embodiment of the present invention as shown in FIG. 11, the vertical load bearing member comprises a mini-pile (80) installed in a drilled hole behind the face of the cut prior to the installation of the respective wale above it. Although the mini-pile (80) is shown in FIG. 11 in use with elongated posts (40), it should be recognized that this is not required by the present invention. Rather, posts (40) alone may be used, or mini-piles (80) alone may be used as the vertical load beating member. Alternatively, as shown in FIG. 11, a combination of posts (40) and mini-piles (80) may be used.

The area of the connection of the retaining wall and outer face of the retaining wall system of the present invention is shown in FIG. 8 in greater detail. As shown in FIG. 8, the first tier of facing elements (32*a*) is connected to the first adjacent wale (25*a*) by connector (33*a*), and to the second tier of facing elements (32*b*) by connector (36*a*). These connections (33*a*, 36*a*) may be made in any conventional manner, such as by welded plate connectors. Importantly, these connections (33*a*, 36*a*) are entirely encased within concrete (35*a*) placed between the first tier of facing elements (32*a*) and the retaining wall (20). This configuration provides protection from corrosion for the individual facing element (32*a*, 32*b*) to wale (25*a*, 25*b*) connections (33*a*, 36*a*), and for the individual tieback (26) to wale (25*a*, 25*b*) connections, thus furthering the structural integrity of the overall retaining wall system.

Additional tiers of facing elements (32*b*, 32*c*) are similarly constructed as shown in FIG. 8. As shown in FIG. 8, the second tier of facing elements (32*b*) is connected to the next adjacent wale (25*b*) and to the third tier of facing elements (32*c*) by reinforced concrete connector (37). Reinforced concrete connector (37) is formed of studs or hooks (95), steel reinforcement (96), and the surrounding poured concrete. Again, this configuration furthers the structural integrity of the overall retaining wall system.

Also shown in FIG. 8 are the respective elongated vertical posts (40*a*, 40*b*, 40*c*). A first post (40*a*) extends between the first adjacent concrete wale (25*a*) and the base of the retaining wall. Additional posts (40*b*, 40*c*) extend between adjacent wales (25*a*, 25*b*, 25*c*). These posts (40*a*, 40*b*, 40*c*) may be received along the footing (31) and along respective wales via respective post plates (41).

Further shown in FIG. 8 are wale drains (60) which may be provided in each of the respective concrete wales (25). Wale drains (60) will allow rainwater or groundwater which collects in the backfill material (34) to flow through the respective wales (25) to the subgrade level (SG) where a perforated drain (70) is provided as shown in FIG. 10. With this configuration, groundwater is not retained in the backfill material (34) to the detriment of the structural integrity of the system. To ensure proper drainage, the wale drains (60) should be placed at points along the extent of the concrete wales (25) separate and apart from the locations of the elongated reinforcement posts (40). Additionally, surface water is collected by the concrete (35*a*, 35*b*) shaped in the form of gutters (39) to facilitate the run-off of rainwater or other fluid along the face of the retaining wall system.

Figure 9:
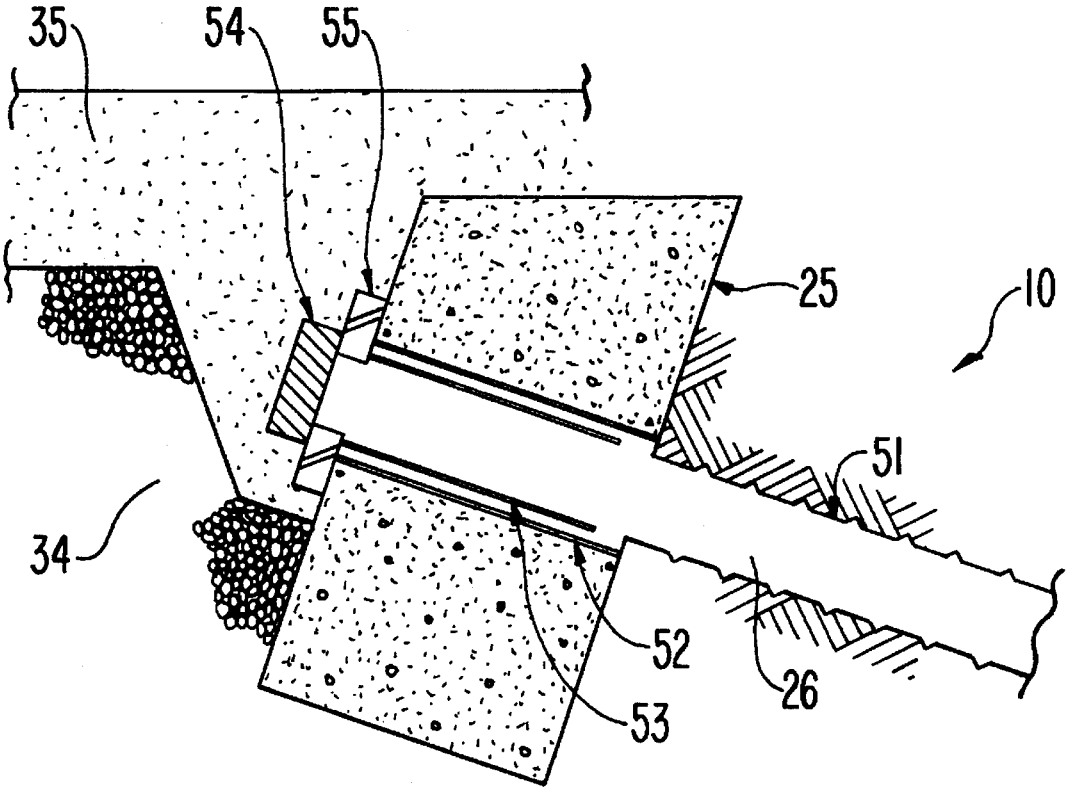
FIG. 9 is a partially broken away sectional view showing the area of the connection of the tieback and the concrete wale of the retaining wall system of the present invention in greater detail.

FIG. 9 shows a typical detail of the connection of a tieback (26) and a concrete wale (25) in the retaining wall system of the present invention. A drilled shaft (51) is provided through the concrete wale (25) and into the existing ground formation (10). A PVC sleeve (52) and trumpet (53) are provided in the concrete wale (25). Each tieback (26) further includes an anchorage (54), and a bearing plate (55) is provided along the face of the concrete wale (25).

FIG. 10 shows the retaining wall system of the present invention at the subgrade level. Pneumatically applied concrete (22) and welded wire mesh (23) are provided along the exposed slope face to the desired final depth of the excavation. A first set of elongated posts (40*a*) extend from the first adjacent concrete wale (25*a*, not shown) to a post plate (41) disposed in the concrete footing (31) at the subgrade level (SG). The first tier of facing elements (32*a*) are erected above the concrete footing (31) and leveling shims (85), such as a neoprene pad, may be provided to align the panels. Backfill material (34*a*) is then placed between the first tier of facing elements (32*a*) and the retaining wall (20).

The present invention thus provides a novel retaining wall system comprised of a retaining wall (20) and an outer face (30). This system is specifically designed for use with ground formations containing cobbles, boulders, cemented soil, weathered rock, or rock because the installation of vertical members through such difficult ground formations. Instead of vertically drilled piles or soldier beams, pneumatically applied concrete (22), concrete wales (25) and tiebacks (26) are used to form the retaining wall of the present invention. An outer face (30) is then added which effectively ties together the wales (25) and tiebacks (26) to further support the excavated slope. Also, vertical load bearing members are provided to support the vertical component of the force associated with the tiebacks and the weight of the system.

In addition, the present invention provides a retaining wall system which is structurally sound yet which is pleasing to the eye. After the retaining wall (20) is formed, the outer face (30) is erected to the full height of the retaining wall (20). This outer face (30) is comprised of a plurality of tiers of facing elements (32) which are effectively tied to the retaining wall (20) to form a unitary retaining wall system. The facing elements (32) of the outer face (30) thus provide a smooth exterior surface for the retaining wall system which is attractive and pleasing to the eye.

From the foregoing detailed description, it will be evident that there are a number of changes, adaptations and modifications of the present invention which come within the province of those skilled in the art. It is intended that all such variations not departing from the spirit of the invention be considered as within the scope thereof as limited solely by the claims appended hereto.

What is claimed is:

1. A method of forming a retaining wall with an outer face comprising the following steps:

excavating a cut in successive sections to form an exposed cut face;

forming a retaining wall by providing a concrete wale which extends substantially horizontally along a portion of the exposed cut face of each successively excavated section, installing tiebacks through said concrete wale, and testing, tensioning and securing said tiebacks against said concrete wale; and forming an outer face for said retaining wall by providing a concrete footing at a base of said retaining wall, erecting a first tier of facing elements above said concrete footing, securing said first tier of facing elements to a first adjacent concrete wale with a first connector, and placing backfill material between said first tier of facing elements and said retaining wall.

2. The method of claim 1 wherein the forming of an outer face for said retaining wall comprises the further steps of:

erecting an additional tier of facing elements above said first adjacent concrete wale, securing said additional tier of facing elements to one of said first adjacent concrete wale and said first tier of facing elements, securing said additional tier of facing elements a next adjacent concrete wale with a second connector, said next adjacent concrete wale being located above said first adjacent concrete wale, and placing additional backfill material between said additional tier of facing elements and said retaining wall.

3. The method of claim 2 wherein the forming of an outer face for said retaining wall comprises the further steps of erecting and securing further additional tiers of facing elements in ascending stages extending to a full height of said retaining wall, and placing further additional backfill material between said retaining wall and each further additional tier of facing elements.

4. The method of claim 3 wherein the step of forming a retaining wall comprises the further step of installing vertical load bearing members at each wale.

5. The method of claim 4 wherein said vertical load bearing members are installed in a drilled hole behind the face of the cut.

6. The method of claim 4 wherein said vertical load bearing members comprise a plurality of elongated posts, said elongated posts disposed between adjacent concrete wales.

7. The method of claim 2 wherein said step of securing said additional tier of facing elements to said first tier of facing elements includes securing a panel connector between said additional tier of facing elements and said first tier of facing elements.

8. The method of claim 2 wherein said second connector comprises reinforced concrete.

9. The method of claim 2 wherein said second connector comprises a connecting means encased in concrete.

10. The method of claim 2 wherein said second connector has a top surface profile which facilitates drainage.

11. The method of claim 2 wherein said additional tier of facing elements bears directly on said first adjacent concrete wale.

12. The method of claim 1 wherein the step of forming a retaining wall comprises the further step of installing vertical load bearing members at said first adjacent concrete wale.

13. The method of claim 12 wherein said vertical load bearing members are installed in a drilled hole behind the face of the cut.

14. The method of claim 12 wherein said vertical load bearing members comprise a plurality of elongated posts, said elongated posts extending between said first adjacent concrete wale and said concrete footing.

15. The method of claim 12 wherein said vertical load bearing members are installed after the formation of said retaining wall but prior to the formation of said outer face.

16. The method of claim 1 wherein said first connector comprises reinforced concrete.

17. The method of claim 1 wherein said first connector comprises a connecting means encased in concrete.

18. The method of claim 1 wherein said first connector has a top surface profile which facilitates drainage.

19. The method of claim 1 wherein said first tier of facing elements bears directly on said concrete footing.

20. The method of claim 1 wherein said facing elements are formed from pre-cast concrete.

21. The method of claim 1 wherein said facing elements are formed from masonry.

22. The method of claim 1 wherein said facing elements are gabions.

23. The method of claim 1 comprising the further step of temporarily shoring up the exposed cut face of each successively excavated section with pneumatically applied concrete.

24. The method of claim 23 wherein said step of shoring up the exposed cut face of each successively excavated section further comprises an installation of a plurality of soil nails.

25. The method of claim 23 wherein said step of shoring up the exposed cut face of each successively excavated section further comprises a placement of wire mesh within said pneumatically applied concrete.

26. The method of claim 23 wherein said pneumatically applied concrete is fiber reinforced.

27. The method of claim 23 wherein said pneumatically applied concrete is shotcrete.

28. The method of claim 23 wherein said pneumatically applied concrete is gunite.

29. The method of claim 1 wherein said backfill material is free-draining granular material.

30. A retaining wall system for a cut formed in successively excavated sections comprising:

a retaining wall, said retaining wall including a concrete wale extending substantially horizontally along a portion of an exposed cut face of each successively excavated section, and tiebacks installed through said concrete wales, said tiebacks tested, tensioned and secured against said concrete wales; and an outer face, said outer face including a concrete footing formed at a base of said retaining wall, a first tier of facing elements erected above said concrete footing, said first tier of facing elements secured to a first adjacent concrete wale with a first connector, and backfill material placed between said first tier of facing elements and said retaining wall.

31. The retaining wall system of claim 30 further comprising:

an additional tier of facing elements erected above said first adjacent concrete wale, said additional tier of facing elements secured to one of said first adjacent concrete wale and said first tier of facing elements, said additional tier of facing elements also connected to a next adjacent concrete wale with a second connector, said next adjacent concrete wale being located above said first adjacent concrete wale, and additional backfill material placed between said additional tier of facing elements and said retaining wall.

32. The retaining wall system of claim 31 wherein further additional tiers of facing elements are erected and secured in ascending stages extending to a full height of said retaining wall, and wherein further additional backfill material is placed between said retaining wall and each further additional tier of facing elements.

33. The retaining wall system of claim 32 further comprising vertical load bearing members at each wale.

34. The retaining wall system of claim 33 wherein said vertical load bearing members are installed in a drilled hole behind the face of the cut.

35. The retaining wall system of claim 33 wherein said vertical load bearing members comprise a plurality of elongated posts, said elongated posts disposed between adjacent concrete wales.

36. The retaining wall system of claim 31 wherein said additional tier of facing elements is secured to said first tier of facing elements with a panel connector extending between said additional tier of facing elements and said first tier of facing elements.

37. The retaining wall system of claim 31 wherein said second connector comprises reinforced concrete.

38. The retaining wall system of claim 31 wherein said second connector comprises a connecting means encased in concrete.

39. The retaining wall system of claim 31 wherein said second connector has a top surface profile which facilitates drainage.

40. The retaining wall system of claim 31 wherein said additional tier of facing elements bears directly on said first adjacent concrete wale.

41. The retaining wall system of claim 30 further comprising vertical load bearing members at said first adjacent concrete wale.

42. The retaining wall system of claim 41 wherein said vertical load bearing members are installed in a drilled hole behind the face of the cut.

43. The retaining wall system of claim 41 wherein said vertical load bearing members comprise a plurality of elongated posts, said elongated posts extending between said first adjacent concrete wale and said concrete footing.

44. The retaining wall system of claim 41 wherein said vertical load bearing members are installed after the formation of said retaining wall but prior to the formation of said outer face.

45. The retaining wall system of claim 30 wherein said first connector comprises reinforced concrete.

46. The retaining wall system of claim 30 wherein said first connector comprises a connecting means encased in concrete.

47. The retaining wall system of claim 30 wherein said first connector has a top surface profile which facilitates drainage.

48. The retaining wall system of claim 30 wherein said first tier of facing elements bears directly on said concrete footing.

49. The retaining wall system of claim 30 wherein said concrete wale is formed from cast-in-place reinforced concrete.

50. The retaining wall system of claim 30 wherein said concrete wale is formed from pre-cast reinforced concrete.

51. The retaining wall system of claim 30 wherein said concrete wale is formed from cast-in-place post-tensioned concrete.

52. The retaining wall system of claim 30 wherein said facing elements are formed from pre-cast concrete.

53. The retaining wall system of claim 30 wherein said facing elements are formed from masonry.

54. The retaining wall system of claim 30 wherein said facing elements are gabions.

55. The retaining wall system of claim 30 wherein said backfill material is free-draining granular material.

56. The retaining wall system of claim 30 further comprising temporary support for the exposed cut face of each successively excavated section, said temporary support comprising pneumatically applied concrete.

57. The retaining wall system of claim 56 wherein said temporary support further comprises a plurality of soil nails placed along a exposed slope face of each successively excavated section.

58. The retaining wall system of claim 56 wherein said temporary support further comprises wire mesh placed within said pneumatically applied concrete.

59. The retaining wall system of claim 56 wherein said pneumatically applied concrete is fiber reinforced.

60. The retaining wall system of claim 56 wherein said pneumatically applied concrete is shotcrete.

61. The retaining wall system of claim 56 wherein said pneumatically applied concrete is gunite.

* * * * *